US005760358A

United States Patent [19]

Plettner

[11] Patent Number: 5,760,358

[45] Date of Patent: Jun. 2, 1998

[54] HYDRAULIC DEVICE FOR OPERATING A DRIVE PISTON FOR A MOVING COMPONENT

[75] Inventor: Horst Plettner, Hanau, Germany

[73] Assignee: ABB Patent GmbH, Mannheim, Germany

[21] Appl. No.: 690,069

[22] Filed: Jul. 31, 1996

Related U.S. Application Data

[63] Continuation-in-part of Ser. No. 346,071, Nov. 29, 1994, abandoned.

[51] Int. Cl.[6] ..... H01H 33/02; F15B 15/17

[52] U.S. Cl. ..... 218/154; 91/416; 91/38; 137/100; 200/82 B

[58] Field of Search ..... 60/394, 413; 91/38, 91/171, 471, 517, 518, 523, 451, 452, 433, 446, 416; 137/87.01, 100, 459, 460, 462, 625.66; 200/81.4, 81.5, 82 R, 82 B; 218/7, 14, 43, 51, 52, 58, 66, 68, 78, 83, 84, 86, 87, 88, 92, 94, 109, 120, 140, 154

[56] References Cited

U.S. PATENT DOCUMENTS

| | | | |
|---|---|---|---|
| 3,012,541 | 12/1961 | Meulendyk | 121/38 |
| 3,656,404 | 4/1972 | Landenzon | 91/38 |
| 3,863,547 | 2/1975 | Meier et al. | 91/416 |
| 3,896,852 | 7/1975 | Holmes | 137/596.18 |
| 4,471,797 | 9/1984 | Cass et al. | 137/100 |
| 4,785,712 | 11/1988 | Yoshizumi et al. | 91/43 |
| 5,353,594 | 10/1994 | Yamashita et al. | 60/413 |
| 5,419,236 | 5/1995 | Plettner | 91/416 |
| 5,476,030 | 12/1995 | Plettner | 91/38 |

FOREIGN PATENT DOCUMENTS

| | | | |
|---|---|---|---|
| 0061786 | 10/1982 | European Pat. Off. | H01H 33/34 |
| 3447132 | 8/1988 | Germany | H01H 33/34 |
| 9013400.1 | 1/1991 | Germany | H01H 33/34 |
| 9111861.1 | 1/1992 | Germany | H01H 33/34 |

OTHER PUBLICATIONS

Schaltanlagen, Balzer et al., ABB Schaltanlagen GmbH, Mannheim, Fed.Rep.Of Germany, 9th Edition, pp. 434–439, 1992.

*Primary Examiner*—Michael L. Gellner
*Assistant Examiner*—Michael A. Friedhofer

[57] ABSTRACT

A hydraulic device for a moving contact piece of a high-voltage power circuit breaker includes a reservoir and a low-pressure tank for hydraulic fluid. A changeover valve has a slide for alternately connecting one of the spaces in the drive-piston/cylinder configuration to the reservoir and to the low-pressure tank. At least one separately controlled and arranged control piston is associated with the slide. A servovalve controls the at least one control piston to drive the slide from a first position to a second position, i.e., from a connected position to a disconnected position of the power circuit breaker.

4 Claims, 2 Drawing Sheets

HYDRAULIC DEVICE FOR OPERATING A DRIVE PISTON FOR A MOVING COMPONENT

CROSS-REFERENCE TO RELATED APPLICATION

This application is a continuation-in-part of my application Ser. No. 08/346,071, filed Nov. 29, 1994, now abandoned.

BACKGROUND OF THE INVENTION

FIELD OF THE INVENTION

The invention relates to a hydraulic device for operating a drive-piston/cylinder configuration for a moving component, especially for a moving contact piece of a high-voltage power circuit breaker, having a reservoir for hydraulic fluid and a changeover valve by means of which one of the spaces in the drive-piston/cylinder configuration can be alternately connected to the reservoir or to a low-pressure tank.

Such a hydraulic device is used for driving and/or operating the moving contact piece of a power circuit breaker. The hydraulic device has a reservoir for the hydraulic fluid and a suitable number of changeover valves by means of which the respective spaces of the piston can be alternately connected to the reservoir or to a low-pressure tank. In the case of a known configuration, the reservoir has a plate spring system which is compressed to charge the reservoir and in consequence absorbs spring energy. The plate spring system acts on a piston/cylinder configuration having a cylinder space with a larger piston surface in which the hydraulic fluid is provided. By releasing that pressurized hydraulic fluid to the low-pressure tank through the changeover valve, the operating piston or pistons of the power circuit breaker is/are operated so that the circuit breaker can be moved into the disconnected position or connected position.

Such a hydraulic drive has been disclosed, for example, in German Utility Model DE-GM 91 11 861 U.

High-voltage power circuit breakers which are operated by such a hydraulic drive can extinguish the current to be disconnected only at the zero crossing. In the event of a short-circuit current, the alternating-current element is superimposed on a decaying direct-current element in such a way that the switching capacity of the power circuit breaker becomes larger as the direct-current element decays.

For that reason, in a number of cases, especially in the case of switching devices in the U.S.A., a delaying electrical relay was connected in the disconnection circuit so that the disconnection process was delayed, as a result of which the disconnection capacity was actually increased. However, for reasons of reliability, power circuit breakers should be disconnected on a direct route without any additional possible interference elements in the disconnection circuit, as there could be in the case of a relay, adversely affecting the functional capability of the power circuit breaker.

SUMMARY OF THE INVENTION

It is accordingly an object of the invention to provide a hydraulic device for operating a drive piston for a moving component, which overcomes the hereinafore-mentioned disadvantages of the heretofore-known devices of this general type and with which power circuit breakers are disconnected on a direct route without any additional possible interference elements in a disconnection circuit.

With the foregoing and other objects in view there is provided, in combination with a high-voltage power circuit breaker having a moving contact piece, a hydraulic device and a drive-piston/cylinder configuration operated by the hydraulic device for actuating the moving contact piece of the high-voltage power circuit breaker, comprising:

a reservoir and a low-pressure tank for hydraulic fluid;

a changeover valve having a slide for alternately connecting one of the spaces in the drive-piston/cylinder configuration to the reservoir and to the low-pressure tank;

at least one separately contolled and arranged control piston associated with the slide; and a servovalve for controlling the at least one control piston to drive the slide and the contact piece of the power circuit breaker from a connected position to a disconnected position of the power circuit breaker.

Thus, according to the invention, a control piston or an auxiliary piston is assigned to the changeover valve with respect to its disconnection direction, which is controlled independently of the slide of the changeover valve and which drives the control slide (also referred to as a slide for short) of the changeover valve in the disconnection direction, and in which the space between the control piston or auxiliary piston and the slide of the changeover valve is relieved of stress by a servovalve, in such a way that the slide is moved by the pressure fluid, which is present as before on the opposite side of the control piston, so that the slide is displaced by the control piston in the disconnection direction and the changeover valve is changed over, as a result of which the disconnection is brought about.

In accordance with another feature of the invention, a larger piston surface of the control piston is located on the side facing the slide, and a space in the control-piston/cylinder configuration which is located between the larger piston surface and the slide is connected on one hand to the reservoir and on the other hand, through the servovalve, to a lowpressure tank.

The operation is as follows:

A disconnection signal is passed to the servovalve in order to disconnect the power circuit breaker. This servovalve releases the route for the hydraulic fluid from the space between the control piston and the slide of the changeover valve so that the control piston can be moved towards the slide. After it strikes the slide, the latter is moved by the control piston into the position which brings about the disconnection of the power circuit breaker.

In accordance with a further feature of the invention, the smaller piston area surface borders another space, pressure fluid is applied to the spaces at both of the surfaces of the control piston, and the control piston is moved back to an original position being removed from the slide of the changeover valve after operation of the slide.

In accordance with an added feature of the invention, the control piston has a stroke being adjustable for setting a drive delay of the slide of the changeover valve. The intermediate connection of the control piston produces the delay which can be adjusted through the stroke setting of the control piston.

With the objects of the invention in view, there is also provided a hydraulic device for a high-voltage power circuit breaker having a changeover valve with a slide, comprising a control piston causing a delayed changeover of the slide for producing a delayed disconnection of the circuit breaker.

In accordance with a concomitant feature of the invention, the changeover valve has an electromagnet system for reconnection.

Other features which are considered as characteristic for the invention are set forth in the appended claims.

Although the invention is illustrated and described herein as embodied in a hydraulic device for operating a drive piston for a moving component, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFFERED EMBODIMENTS

Figure 1:
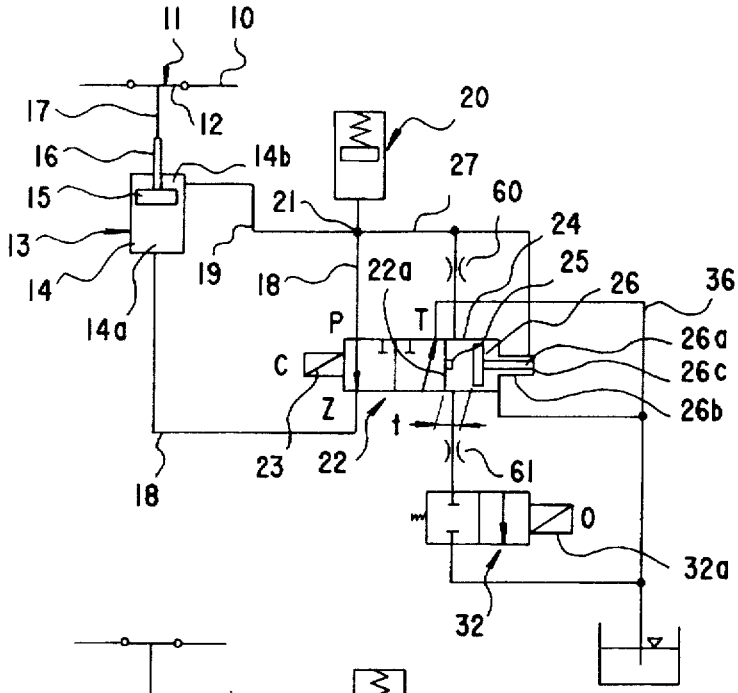
FIG. 1 is a schematic circuit diagram of a hydraulic device according to the invention in a connected position.
Figure 2:
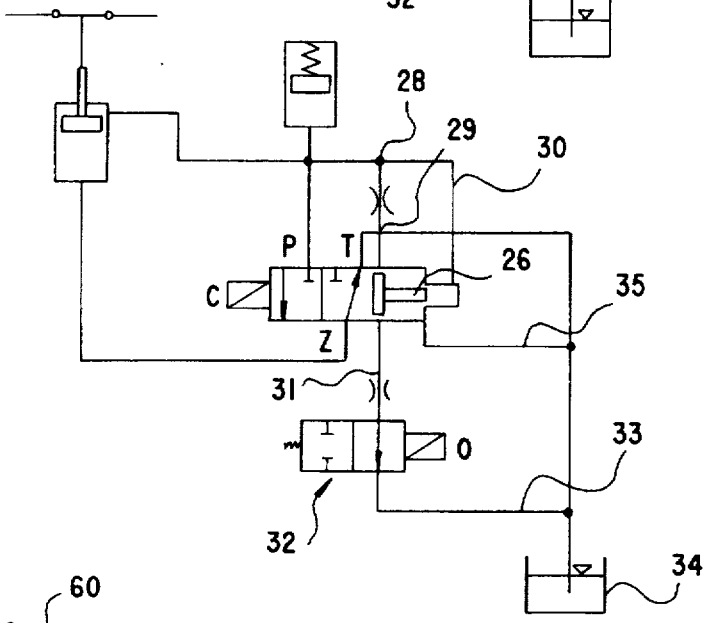
FIG. 2 is a diagram of the hydraulic device according to FIG. 1 at the start of a disconnection operation.
Figure 3:
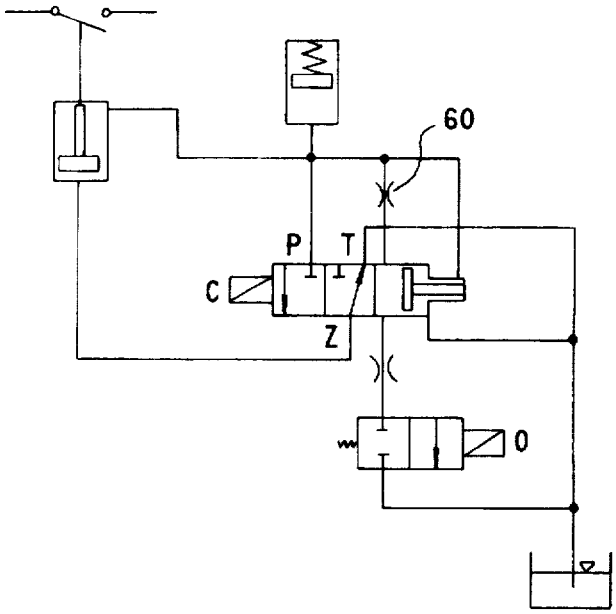
FIG. 3 is a diagram of the hydraulic device according to FIGS. 1 and 2 in a disconnected position.

Referring now to the figures of the drawing in detail and first, particularly, to FIGS. 1 to 3 thereof, there is seen an electrical high-voltage power circuit breaker 11 which is located in a line network or mains 10 and may be a metal-encapsulated, $SF_6$ gas-insulated circuit breaker or an open-air circuit breaker or the like having a number of moving contact pieces 12 which correspond to the number of phases. The moving contact pieces are illustrated as rotatable contact pieces but, in fact, may also be contact pieces which can move linearly. The movable contact pieces 12 in each case are operated by a drive-piston/cylinder configuration 13 that has a cylinder space 14 in which a piston 15 can move in a reciprocating manner. A piston rod 16 which is connected to the piston 15 is connected through an intermediate element 17 to the moving contact piece 12. The operating cylinder space 14 is divided by the piston 15 into a space **14*a* underneath the piston and a space 14*b* above the piston. The space 14*a* is bounded by a larger surface of the piston 15 and the space 14*b* is bounded by a piston surface which is reduced by the piston rod cross-section. A fluid line 18 opens into the space 14*a* and a fluid line 19 opens into the space 14*b*. The spaces are connected to a pressure fluid reservoir 20 and the lines 18 and 19 are connected to one another at a junction point 21. A changeover valve 22 is located in the line 18 between the space 14*a* and the junction point 21. The changeover valve 22 has a connection magnet system 23 on one side and a control-piston/cylinder configuration 24** on the other side, for the purpose of disconnection.

A control piston 26 is located in the control-piston/cylinder configuration 24. As can be seen in FIG. 1, the control piston 26 can be moved through a specific adjustable stroke t within the control-piston/cylinder configuration 24. A guide rod **26*a*, which is guided in a recess 26*b*, is connected to a surface of the control piston 26 opposite the changeover valve 22**.

In addition to the line 18, which passes through the changeover valve 22, a line 27 is connected to the junction point 21. The line 27 branches at a junction point 28 into a line 29 and a line 30. The line 29 opens into a space between the control piston 26 and the slide **22*a* having the projection 25. A further line 31 opens from this space into one side of a servovalve 32 which has another side connected through a line 33 to a low-pressure tank 34. The line 30 opens into a space in the control-piston/cylinder configuration 24 which faces away from the slide 22*a*. A free end of the guide rod 26*a* on the piston side ends in a piston surface 26*c* which has a smaller cross-section than the piston surface of the control piston 26 and at which high-pressure fluid is continuously present, through the line 30. A leakage fluid line 35, which leads to the low-pressure container 34, is connected between the piston 26 and the smaller piston surface 26*c***.

A line 36 which likewise opens into the low-pressure tank is connected to the changeover valve.

Figure 4:
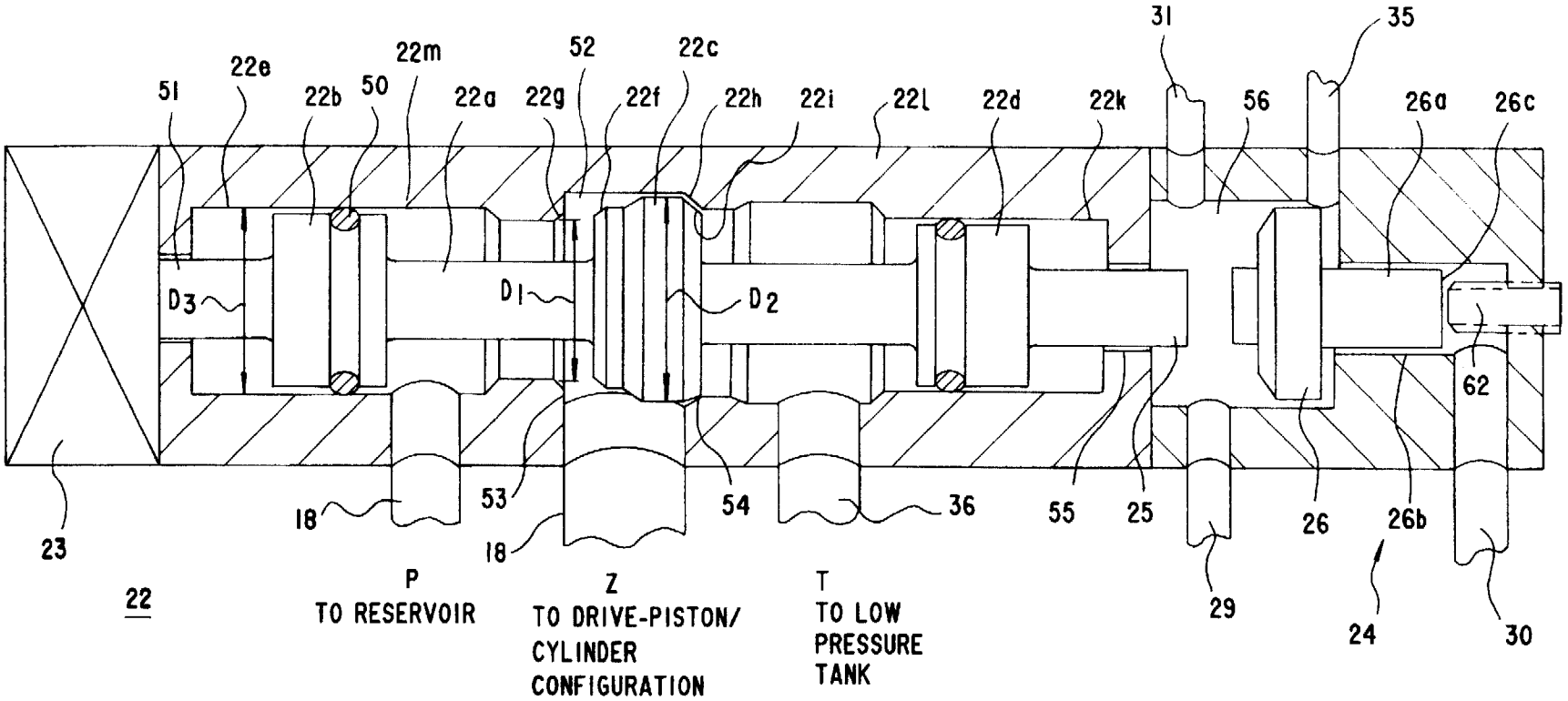
FIG. 4 is a diagrammatic, sectional view of a changeover valve having a delay device.

The changeover valve 22 is detailed in FIG. 4. The valve 22 includes a housing 221 which is formed with a bore **22*m* with differing segments. A plunger 22*a* or slide is disposed inside the bore 22*m*. The electromagnet system 23 is located at the left end of the figure and the control piston/cylinder configuration 24** is located on the right.

The slide **22*a* has a piston 22*b* at its left end. The outer diameter of the piston 22*b* is $D_3$ and it is guided within the bore segment 22*a*, where it is sealingly guided with a seal 50 (O-ring seal). A journal 51 is disposed adjacent the piston 22*b* at the left, i.e. towards the electromagnet system 23. The electromagnet system 23 acts on the journal 51. A piston 22*c* is located approximately centrally on the slide 22*a*, with an outer diameter $D_2$. The piston 22*c* moves in a space 52, which is limited on either side by steps 53 and 54, respectively. A valve seat 22*g* is located at the step 53 which comes into communication with the valve seat 22*f* of the piston 22*c* when the slide 22*a* is driven towards the left. The diameter of the sealing seat 22*g*/22*f* is $D_1$. The step 54 has a valve seat 22*h* which is in contact (in the illustrated position) with a sealing surface 22*i* at the piston 22*c***.

At the right-hand end, the slide **22*a* carries a piston 22*d*, which is guided in a bore segment 22*k*. A projection 25 continues at the end of the piston 22*d* which is distal from the electromagnet system 23. The projection 25 reaches through a bore 55 and into a space 56, when the slide is located in its position illustrated in FIG. 4. The space 56 defines the cylinder space of the control piston/cylinder configuration 24 in which the control piston 26 moves. The control piston 26 comprises a journal 26*a* on the distal side as seen from the electromagnet system 23. The journal 26*a* projects into a dead-end bore 26*b* on the one side, and its other side (free face) is limited by a piston surface 26*c***.

Lines 31 and 29 are connected at the end of the control piston/cylinder configuration 24 adjacent the housing 221. A relief connector is located at that side of the piston 26 which faces towards the bottom of the cylinder space 56. The line 30 connects between the bottom of the bore **26*b* and the piston surface 26*c***.

In the embodiment of the slide **22*a*** according to FIG. 4, the diameter $D_3$ is greater than the diameter $D_1$ ($D_3>D_1$) and the diameter $D_2$ is greater than the diameter $D_1$ ($D_{2\ i\ >D1}$)

The operation of the system is as follows:

FIG. 1 shows a connected position in which the moving contact piece 12 is located in a closed position. The piston 15 is located at an uppermost point since pressure fluid coming from the reservoir 20 is forced both into the space **14*b* and into the space 14*a*, both through the line 19 and through the line 18, as a result of the position of the slide of the changeover valve. The position of the piston 15** in the configuration illustrated in FIG. 1 is reached because of the different piston surface (piston areas). The changeover valve 22 is in a blocking position in which one piston 22c, which is integrally formed on the slide 22a, is removed from its valve seat 22g and lies in contact at its valve seat 22n with its valve seat 22i. As a consequence, the energy reservoir 20 is connected through the line 18 with the working cylinder 13 (i.e. the line 18 is not interrupted), while the line from the working cylinder to the low pressure tank 34 is blocked.

The slide 22a is retained in the position illustrated in FIG. 4, because the high pressure in the space between the piston 22b and the piston 22c forces the slide towards the right. Due to the fact that the diameter D2 is greater than the diameter D3, the pressure force acting on the left-hand surface of the piston 22c is greater than the force acting on the adjacent or opposite right-hand surface of the piston 22b.

If it is then intended to disconnect the circuit breaker, the electromagnet system 32a of the servovalve 32 is actuated, so that this valve is controlled into the open position, as can be seen in FIG. 2. As a consequence, the space 56 between the projection 25 and the control piston 26 is relieved, so that as a result of the pressure which is present on the piston surface 26c, the control piston 26 is moved to the left. The control piston 26 requires a certain amount of time for this movement to the left. This time can be set by means of two throttles 60, 61 located behind the space 56 in such a way as to reach a desired disconnection delay, which is discussed below. The control piston 26 reverses the reversing slide 22a of the changeover valve into the open position, in which the control piston 26 moves the slide 22a to the left, until the valve seat 22f of the piston 22c contacts the valve seat 22g in the housing 221. As a consequence, the space 14a is connected through the reversing valve to the line 36 and thus to the low-pressure tank 34, so that the piston 15 (due to the pressure drop) is moved in the switch-off direction (FIG. 3), and the switch is opened, because the pressure fluid still pushes against the smaller piston surface of the piston 15. In this position, i.e. when the two valve seats 22f and 22g are forced in contact with each other, there still exists high pressure in the space between the piston 22b and 22c. Due to the fact, however, that the diameter $D_1$ is smaller than the diameter $D_3$, the increased pressure force resulting from the greater piston surface of the piston 22b overcomes the pressure force produced by the surface within the valve seat 22f/22g. In that position, the slide 22a is hydraulically maintained in its left-hand position.

The control piston 26, which has pushed the slide 22a towards the left, has not covered up the bore communicating with the line 29 or the bore communicating with the line 31 in that position, so that, when the servovalve once more reaches the position of FIG. 1 or FIG. 3 (in which the passage to the low pressure tank is blocked), pressure fluid is present in the space left of the control piston 26. Accordingly, that pressure fluid forces the control piston 26 to slide into the position of FIG. 4.

A set screw 62 is threaded into the bottom of the control piston/cylinder configuration 24. The set screw 62 allows an adjustment of the spacing between the control piston 26 and the projection 25, and thus the delay time of the circuit breaker system.

As is indicated above, the servovalve 32 is controlled and opened electromagnetically in such a way that the pressure in front of the control piston 26 is reduced. The intermediate connection of the hydraulic control piston produces a delay in the disconnection, that is to say the operation of the changeover valve 22. It is possible to set this delay by means of the stroke t. This results in the switch not being moved into the disconnected position until after the decay time of the direct-current element, so that safe switching is achieved at the zero crossing. The servovalve 32 is controlled into the off position and closes even during the movement of the piston 15, by means of a non-illustrated auxiliary contact module of the power circuit breaker drive. The servovalve 32 reaches the position according to FIG. 3, wherein the pressure which builds up in front of the control piston 26 then forces the control piston 26 into the socalled disconnected position again, with the movement of the control piston 26 being respectively influenced or set by a respective restrictor 60 or throttle 60. Only the electromagnetic system 23 is used for driving the changeover valve 22 to the connected position. A control piston which produces a delay is thus no longer necessary.

Referring once more to the question as to how the slide within the valve 22 is held in its two end positions: When, as illustrated, the energy reservoir 20 is in communication with the working cylinder or the working piston 13, the slide is held in the illustrated position because the pressure left of the piston 22c overcomes the pressure on the right side (low pressure right of the piston 22c). Also, the pressure from the energy reservoir to the left of the piston 22c acts on the piston 22b on the one hand and on the piston 22c on the other hand. The diameter $D_2$ of the piston 22c is greater than the diameter $D_3$ of the piston 22b. Accordingly, the pressure fluid on the left of the piston 22c always forces towards the right, so that the pistion 22c comes to lie against the seat 22h and thus prevents a flow-through from the high pressure tank to the low pressure tank.

When the piston (the slide) is redirected within the valve 22, so that the piston 22c moves to the left, which is effected by the auxiliary piston device 24 on the right-hand side of the housing of the valve 22, then the surface 22f of the piston 22c comes to lie on the surface 22g. This connects the cylinder 13 with the low pressure tank 14. Due to the fact that the diameter $D_3$ of the piston 22b is greater than the diameter $D_1$ of the seat 22f/22g, the slide remains pushed to the left because the pressure force acting on the piston 22b (larger diameter $D_3$) is greater than the face of the piston 22c within the valve seat 22f/22g (smaller diameter $D_1$). Accordingly, the slide remains in the position in which the sealing seats 22f and 22g abut one another, i.e. in which the slide is in its left-hand position, because of the hydraulic differential pressure forces.

I claim:

1. In combination with a high-voltage power circuit breaker having a moving contact piece, a hydraulic device and a drive-piston/cylinder configuration having spaces formed therein and operated by said hydraulic device for actuating the moving contact piece of the high-voltage power circuit breaker, comprising:

a reservoir and a low-pressure tank for hydraulic fluid;

a changeover valve having a slide for alternately connecting one of the spaces in the drive-piston/cylinder configuration to said reservoir and to said low-pressure tank;

at least one separately controlled and arranged control piston associated with said slide;

a servovalve for controlling said at least one control piston to drive said slide and the contact piece of the power circuit breaker from a connected position to a disconnected position of the power circuit breaker; and said at least one control piston having a surface with a larger area and a surface with a smaller area, said larger area piston surface facing said slide of said changeover valve, and said larger area piston surface and said slide define a space therebetween connectible to said reservoir and connectible through said servovalve to said low-pressure tank.

2. The hydraulic device according to claim 1, wherein said smaller piston area surface borders another space, pressure fluid is applied to said spaces at both of said surfaces of said control piston, and said control piston is moved back to an original position being removed from said slide of said changeover valve after operation of said slide.

3. The hydraulic device according to claim 2, wherein said control piston has a stroke being adjustable for setting a drive delay of said slide of said changeover valve.

4. In combination with a high-voltage power circuit breaker of the type having a moving contact piece which is selectively moved between a connected position in which the power circuit breaker is conducting and a disconnected position in which the power circuit breaker is interrupted, a hydraulic device and a drive-piston/cylinder configuration actuated by the hydraulic device for moving said contact piece between the connected and disconnected positions;

said drive-piston/cylinder configuration comprising a piston and a cylinder having a plurality of spaces formed therein;

said hydraulic device comprising a reservoir and a low-pressure tank for hydraulic fluid;

a changeover valve connected between said reservoir, said low-pressure tank and said spaces of said piston/cylinder configuration, said changeover valve including a slide for alternately connecting one of said spaces in said drivepiston/cylinder configuration to said reservoir and to said low-pressure tank;

a separately controlled and arranged control piston associated with said slide;

a servovalve connected to and controlling said control piston to drive said slide from the connected position to the disconnected position of the power circuit breaker; and said control piston having a surface with a larger area and a surface with a smaller area, said larger area piston surface facing said slide of said changeover valve, and said larger area piston surface and said slide define a space therebetween connectible to said reservoir and connectible through said servovalve to said low-pressure tank.

* * * * *

UNITED STATES PATENT AND TRADEMARK OFFICE

CERTIFICATE OF CORRECTION

PATENT NO : 5,760,358

DATED : June 2, 1998

INVENTOR(S) : Horst Plettner

It is certified that error appears in the above-identified patent and that said Letters Patent is hereby corrected as shown below:

On the title page,

Item [30] should read as follows:

Nov. 29, 1993 [DE] Germany ..... 43 40 533

Signed and Sealed this

First Day of June, 1999

*Attest:*

*Attesting Officer*

Q. TODD DICKINSON

*Acting Commissioner of Patents and Trademarks*